United States Patent [19]

Bestenreiner et al.

[11] 4,179,210

[45] Dec. 18, 1979

[54] APPARATUS FOR DEVELOPING LATENT ELECTROSTATIC IMAGES

[75] Inventors: Friedrich Bestenreiner, Grünwald; Dieter Giglberger, Unterhaching; Karl Hoeft, Germering; Robert Kohler, Olching, all of Fed. Rep. of Germany

[73] Assignee: AGFA-Gevaert, A.G., Leverkusen, Fed. Rep. of Germany

[21] Appl. No.: 836,541

[22] Filed: Sep. 26, 1977

[30] Foreign Application Priority Data

Sep. 30, 1976 [DE] Fed. Rep. of Germany ..... 2644216

[51] Int. Cl.[2] ..... G03G 15/10; G03D 3/02

[52] U.S. Cl. ..... 355/10; 118/647; 118/660; 354/324

[58] Field of Search ..... 355/3 R, 10; 354/317, 354/324; 118/DIG. 23, 647, 648, 659, 660; 427/15

[56] References Cited

U.S. PATENT DOCUMENTS

| | | | |
|---|---|---|---|
| 2,752,833 | 7/1956 | Jacob | 355/10 |
| 3,027,821 | 4/1962 | Wright | 354/317 X |
| 3,176,653 | 4/1965 | Hansen | 118/647 |
| 3,407,786 | 10/1968 | Beyer et al. | 118/647 X |
| 3,758,204 | 9/1973 | Mochizuki | 355/10 |
| 3,871,013 | 3/1975 | Burke et al. | 354/317 |
| 3,878,817 | 4/1975 | Kuehnle | 118/647 |
| 3,957,368 | 5/1976 | Goshima et al. | 355/10 X |
| 4,013,356 | 3/1977 | Bestenreiner et al. | 355/10 |

*Primary Examiner*—Fred L. Braun
*Attorney, Agent, or Firm*—Peter K. Kontler

[57] ABSTRACT

Apparatus for developing latent electrostatic images on dielectric carrier sheets has a rotary cylinder whose periphery supports a carrier sheet with a latent image thereon, and a metallic block having a concave surface which constitutes a grounded electrode and defines with the exposed side of the carrier sheet on the cylinder a narrow gap of constant or gradually decreasing width, as considered in the direction of rotation of the cylinder. The block has alternating fluid-admitting and fluid-evacuating orifices which communicate with the gap and extend transversely of the path of movement of the carrier sheet. Each fluid-admitting orifice is nearer to the preceding than to the next-following fluid-evacuating orifice, and the width of the fluid-evacuating orifices exceeds the width of the fluid-admitting orifices. The block is located below the cylinder and the fluid-evacuating orifices communicate with a collecting tank into which spent developing fluid flows by gravity. The fluid-admitting orifices receive pressurized fresh developing fluid from a pump. Each unit volume of freshly admitted fluid dwells in the gap for the same interval of time because some of the fluid issuing from a fluid-admitting orifice flows forwardly toward the next-following fluid-evacuating orifice at a speed higher than the speed of the remainder of the fluid issuing from the same fluid-admitting orifice and flowing backwards toward the preceding fluid-evacuating orifice.

11 Claims, 4 Drawing Figures

APPARATUS FOR DEVELOPING LATENT ELECTROSTATIC IMAGES

BACKGROUND OF THE INVENTION

The present invention relates to apparatus for developing latent electrostatic images on dielectric carrier or receptor sheets. More particularly, the invention relates to improvements in developing apparatus of the type wherein a carrier sheet travels with respect to a stationary electrode and its image-bearing surface is contacted by a developing fluid which contains toner particles.

Commonly owned U.S. Pat. No. 4,013,356 granted Mar. 22, 1977 to Bestenreiner et al. (to which reference may be had, if necessary) discloses a developing apparatus wherein the gap between the electrode and the travelling carrier sheet receives fresh developing fluid by way of fluid-admitting ports which are machined into the electrode. Spent fluid is removed by way of evacuating ports in the electrode. The gap between the moving carrier sheet and the electrode is divided into several sections each of which includes a fluid-admitting port and an evacuating port. The ports are actually narrow slits extending transversely of the direction of movement of the sheet and are inclined with respect to each other. Fresh fluid which issues from the fluid-admitting ports is introduced in such a way that it has a component of movement in the direction of travel of the carrier sheet, and the inclination of the evacuating ports is just the opposite. The aforediscussed inclination of the ports is intended to reduce turbulence in the gap between the electrode and the carrier sheet.

A drawback of the just described apparatus is that certain sections of the gap are not used for development of the latent image. Therefore, the length of the gap, as considered in the direction of movement of carrier sheets, greatly exceeds the combined length of the aforementioned developing sections. Otherwise stated, certain sections of the gap do not receive any developing fluid. Moreover, the evacuation of spent fluid from the corresponding orifices necessitates the expenditure of energy in addition to that energy which is needed to force fresh developing fluid into the gap via fluid-admitting ports.

OBJECTS AND SUMMARY OF THE INVENTION

An object of the invention is to provide a developing apparatus which is simpler and more compact than heretofore known apparatus.

Another object of the invention is to provide a developing apparatus wherein each and every portion or section of the gap between a moving image-bearing sheet and an electrode can be utilized for conversion of latent images into permanent images.

A further object of the invention is to provide a developing apparatus which can furnish permanent images of higher quality than those which are obtainable in heretofore known apparatus.

An additional object of the invention is to provide a developing apparatus wherein no energy must be expended to evacuate spent developing fluid from the gap between the electrode and the carrier sheet.

One feature of the invention resides in the provision of an apparatus for developing latent electrostatic images on carrier sheets. The apparatus comprises a rotary cylinder or analagous means for conveying carrier sheets in a predetermined direction along a predetermined path, electrode means adjacent to and defining with a carrier sheet in the path an elongated gap which may but need not be of constant width and whose width preferably does not exceed 0.5 mm, at least one fluid-admitting first orifice provided in the electrode means and communicating with the gap, at least two fluid-evacuating second orifices provided in the electrode means and communicating with the gap, a source of developing fluid, and means for connecting the source with the first orifice. In accordance with the invention, the first orifice is disposed between the second orifices and the second orifice which is located behind the first orifice, as considered in the direction of transport of carrier sheets, is more distant from the first orifice than the other second orifice which is located ahead of the first orifice. The orifices are preferably elongated slits extending transversely of the path of movement of carrier sheets, and the width of second orifices preferably exceeds the width of the first orifice.

It is presently preferred to place the electrode means below the path for carrier sheets and to provide a tank or analagous means for receiving evacuated developing fluid from the second orifices by gravity flow.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
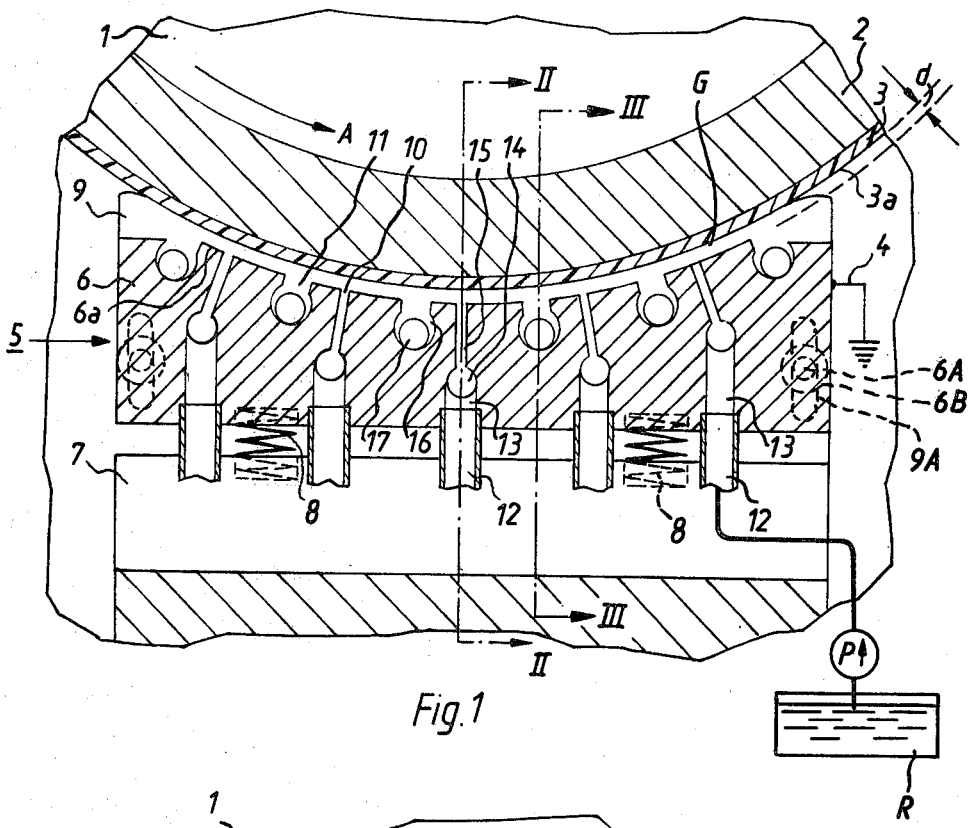
FIG. 1 is a fragmentary partly schematic longitudinal vertical sectional view of a developing apparatus which embodies one form of the invention.
Figure 2:
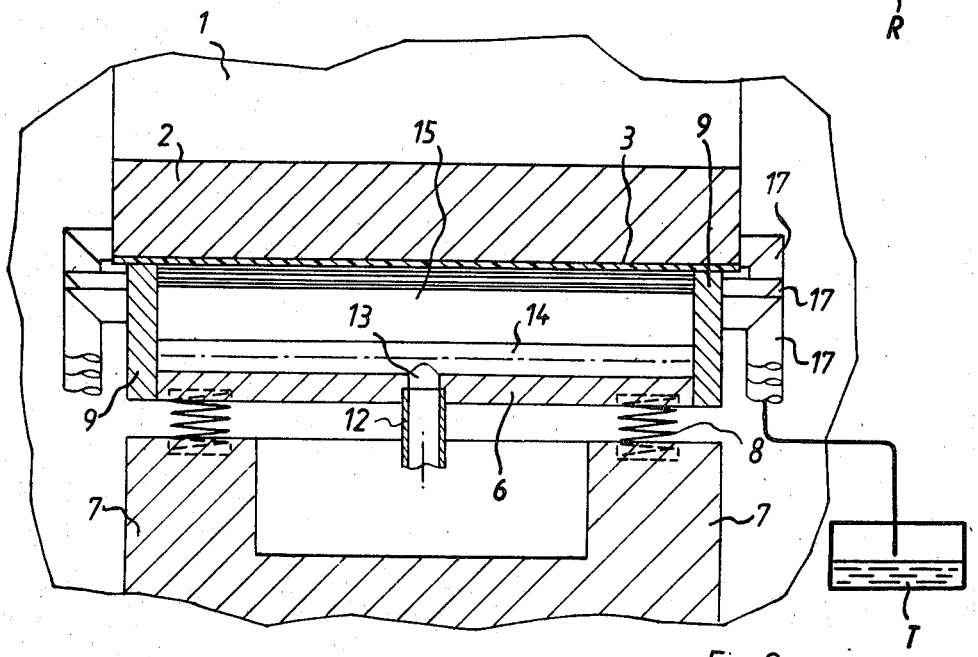
FIG. 2 is a transverse vertical sectional view as seen in the direction of arrows from the line II—II of FIG. 1.
Figure 3:
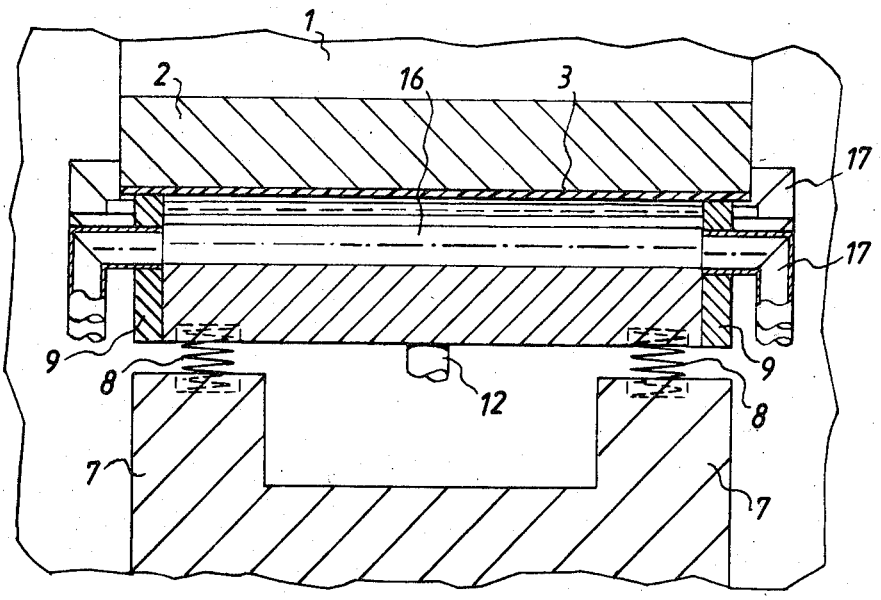
FIG. 3 is a transverse vertical sectional view as seen in the direction of arrows from the line III—III of FIG. 1.

Referring first to FIGS. 1 to 3, there is shown an apparatus for developing latent electrostatic images on dielectric carrier sheets 3. The apparatus comprises a housing 1 which can form part of an orifice copying machine or a machine for developing latent images of X-rayed objects (in the latter instance, the latent images are formed in an ionography imaging chamber). The housing 1 supports the shaft (not shown) of a conveying means 2 here shown as a hollow cylinder which is driven to rotate in the direction indicated by arrow A. A dielectric carrier sheet 3 is secured to the periphery of the cylinder and its image-bearing layer 3*a* faces downwardly, i.e., away from the periphery of the cylinder 2. The manner in which the carrier sheet 3 is affixed to the periphery of the cylinder 2 preparatory to transport through the developing apparatus forms no part of the invention.

The developing unit 5 of the improved apparatus is mounted in the housing 1 at a level below the path for the carrier sheet 3. The unit 5 comprises a metallic block 6 which is connected to the ground by a conductor 4 and whose concave upper surface 6a constitutes an electrode facing the layer 3a of the carrier 3. The width of the clearance or gap G between the layer 3a and the electrode 6a does not exceed 0.5 mm. The block 6 is biased uowardly, i.e., toward the carrier sheet 3, by several springs 8 which react against a support 7 affixed to the housing 1. The bias of the springs 8 is preferably variable, for example, by providing means for adjustably securing the support 7 to the housing 1.

The width of the gap G is determined by two distancing elements or shoes 9 which are disposed in two parallel planes and have concave surfaces bearing against the marginal portions of the carrier sheet 3. The shoes 9 flank the block 6 and are adjustably secured thereto in any suitable manner. FIG. 1 shows that the block 6 mates with screws whose shanks 6A extend through elongated slots 9A of the shoes 9 and whose heads 6B can be moved into frictional engagement with the outer sides of the shoes 9 to thus insure that the upper portions of the shoes extend beyond the electrode 6a to a desired extent, i.e., to thus select the width d of the gap G. The width of the gap G will be altered under certain circumstances, e.g., in response to changes in the rate of admission of fresh developing fluid into such gap and/or in response to changes in the speed of the cylinder 2.

In accordance with a feature of the present invention, the block 6 is formed with alternating fluid-admitting and fluid-evacuating orifices or ports 10 and 11 which are narrow slits extending transversely of the direction of movement of the carrier sheet 3 and preferably all the way between the shoes 9. The shoes 9 prevent escape of developing fluid toward the end faces of the cylinder 2. The orifices or ports 10 and 11 are respectively defined by nozzles 15 and 16 and such orifices communicate with the cap G between the electrode 6a and layer 3a. Each nozzle 15 receives fluid from a discrete supply conduit 12 (e.g., a flexible hose which allows for adjustment of the block 6 relative to the cylinder 2), a bore 13 which is machined into the block 6 and receives fluid from the upper end of the conduit 12, and a distributor channel 14 which is also machined into the block 6 and extends in parallelism with the axis of the cylinder 2.

The nozzles 16 are actually discrete collecting channels which are machined into the block 6 and communicate with discharging conduits 17. As shown in FIGS. 2 and 3, each distributor channel 14 receives fresh fluid from a single supply conduit 12, and each collecting channel 16 communicates with two preferably flexible discharging conduits 17. Portions of the conduits 17 can be soldered or otherwise secured to the respective shoes 9.

FIG. 1 shows that the distance between each orifice 10 and the preceding orifice 11 (as considered in the direction indicated by arrow A) is less than the distance between such orifice 10 and the orifice 11 therebehind. In other words, in order to enter an orifice 11, developing fluid which issues from an orifice 10 must cover a greater distance in the direction of arrow A than counter to such direction.

The operation of the apparatus of FIGS. 1 to 3 is as follows:

A pump P (shown schematically in FIG. 1) draws fresh developing fluid from a reservoir R or an analogous source and supplies such fluid to the conduits 12 for admission into the gap G between the electrode 6a and carrier sheet 3 via bores 13, the distributor channels 14 and orifices 10 of the nozzles 15. The stream of fresh fluid which issues from an orifice 10 is divided into two smaller streams one of which flows in the direction indicated by arrow A and the other of which flows counter to such direction. The carrier sheet 3 tends to accelerate that smaller stream which flows in the direction of arrow A, and the carrier sheet tends to decelerate the other smaller stream which flows in a direction to the left, as viewed in FIG. 1. In other words, the speed of that smaller stream flowing in the direction of arrow A exceeds the speed of the smaller stream which flows in the opposite direction. However, and since the orifice 11 which is located ahead of the just discussed orifice 10 is closer to the orifice 10 than the orifice 11 which is located behind the same orifice 10, the interval of dwell of fluid which forms the two smaller streams in contact with the layer 3a is the same or nearly the same. In other words, the slower smaller stream covers a shorter distance before it reaches an evacuating orifice 11, and the faster smaller stream must cover a greater distance with the aforementioned result. Stated differently, each volumetric unit of fluid issuing from an orifice 10 remains in contact with the layer 3a for the same period of time. Thus, one can say that the rate at which the developing fluid is "spent" (i.e., relieved of toner particles) is the same (or substantially identical) for each volumetric unit of the fluid issuing from the orifices 10.

The spent developing fluid enters the orifices 11 and is evacuated via collecting channels 16 and conduits 17 to enter a tank T shown in FIG. 2. The flow of spent fluid from the gap G between the layer 3a and the electrode 6a into the tank T preferably takes place by gravity, i.e., it is not necessary to employ one or more suction pumps to withdraw spent fluid from the gap G.

An important advantage of the improved apparatus is that the entire gap G can be used for development of latent images on carrier sheets 3. This is best shown in FIG. 1 wherein each of the five illustrated fluid-admitting orifices 10 is flanked by two fluid-evacuating orifices 11. Thus, developing fluid flows in each and every zone or section of the gap G because the rearmost portion of the gap receives a partial stream of fresh developing fluid which issues from the rearmost orifice 10, the next-to-the rearmost orifice 11 receives fluid from the rearmost orifice 10 as well as from the next-to-the-rearmost orifice 10, and so forth. The foremost orifice 11 receives fluid which flows from the foremost orifice 10 counter to the direction indicated by arrow A. Therefore, the overall length (and hence the dimensions) of the apparatus can be reduced to a relatively small fraction of length and dimensions of heretofore known apparatus. Moreover, the interval of time which is needed for development of a latent image is a small fraction of the interval which is needed in conventional apparatus.

Another important advantage of the improved apparatus is that developing fluid which is admitted via ports 10 is spent (the quantity of toner particles therein is reduced) to the same extent in each and every zone of the gap G. This insures optimum utilization of fresh developing fluid and results in the making of high-quality permanent images. The development is much more uniform than in heretofore known apparatus.

The placing of developing unit 5 at a level below the path for the carrier sheets 3 also contributes to greater simplicity of the apparatus and to higher quality of developed images. The flow of spent fluid from the orifices 11 (which are wider than the orifices 10) to the tank T takes place exclusively by gravity and under the influence of pressure which is generated by the pump P. Therefore, the apparatus need not be equipped with suction pumps for withdrawing spent fluid from the orifices 11. The feature that the spent fluid is evacuated by gravity flow insures that the developed images are free of streaks which are typical of images developed in apparatus having suction pumps connected to the evacuating ports. The formation of streaks is attributed to the fact that the suction pump or pumps withdraw toner particles from the surface of the moving carrier sheet in the region of evacuating ports.

As mentioned above, the width of the gap G is a fraction of one millimeter, preferably not more than 0.5 mm. This insures the establishment of a strong electric field which contributes to rapid and uniform development of the latent image.

Figure 4:
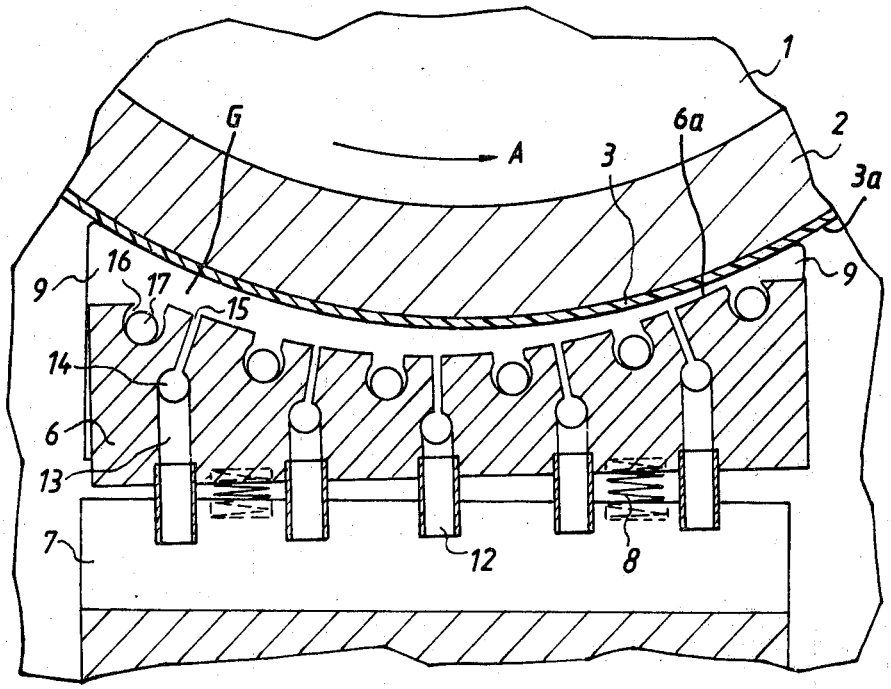
FIG. 4 is a view similar to that of FIG. 1 but showing an arcuate wedge-like gap between the carrier sheet and the electrode.

FIG. 4 illustrates the apparatus FIGS. 1–3 but with a different adjustment of shoes 9 relative to the block 6. The width of the clearance or gap G between the carrier sheet 3 and the electrode 6*a* decreases gradually, as viewed in the direction of arrow A. The marginal portions of the sheet 3 are developed in the wider portion of the arcuate wedge-like gap G (i.e., in that portion in which the electrode 6*a* is located at a maximum distance from the layer 3*a*), and the central zone of the latent image on the layer 3*a* is developed in the narrower portion of the gap. This contributes to a superior toner image of great uniformity. The coloring of developed images is highly satisfactory; it has been found that each and every portion of a darker field in the developed image is of the same or optimum density, i.e., that the darker zones of the image are not interrupted at all regardless of their size and/or shape.

It is also within the purview of the invention to reduce the width of the gap G to zero whenever the apparatus is idle, i.e., when the cylinder 2 does not rotate and the pump P does not deliver fresh developing fluid to the orifices 10. This can be achieved in a very simple manner by loosening the aforementioned screws 6A, 6B so that the electrode 6*a* abuts directly against the layer 3*a*. The block 6 may be provided with skirts which sealingly engage the end faces of the cylinder 6 to prevent uncontrolled escape of developing fluid beyond the marginal portions of the sheet 3. When the pump P begins to deliver pressurized developing fluid, such fluid forms a thin cushion between the layer 3*a* and electrode 6*a* to thus establish a gap G of desired width. The just discussed embodiment renders it possible to keep the width of the gap G to a minimum; such width will be determined by the bias of the springs 8 and by the pressure of fluid which is supplied by the pump P, i.e., by the rate of admission of fluid into the conduits 12.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. In an apparatus for developing latent electrostatic images on carrier sheets, the combination of means for conveying carrier sheets in a predetermined direction along a predetermined path; electrode means adjacent to and defining with a carrier sheet in said path an elongated gap, said electrode means having at least one fluid-admitting first orifice communicating with said gap and at least two fluid-evacuating second orifices communicating with said gap, one of said second orifices being located ahead of and the other of said second orifices being located behind said first orifice, as considered in said direction, and said one second orifice being nearer to said first orifice than said other second orifice; a source of pressurized developing fluid; and means for connecting said source with said first orifice so that the fluid issuing from said first orifice forms first and second streams flowing in and counter to said direction to respectively enter said other and said one second orifice whereby the speed of said first stream exceeds the speed of said second stream as a result of movement of the carrier sheet in said direction, the distances between said first orifice and said second orifices being such that the interval of dwell of each increment of said first stream in said gap at least approximates the interval of dwell of each increment of said second stream in said gap.

2. The combination of claim 1, wherein said orifices are elongated slits extending transversely of said path.

3. The combination of claim 2, wherein the width of said second orifices exceeds the width of said first orifice.

4. The combination of claim 1, wherein said electrode means is located at a level below said path, and further comprising means for receiving evacuated fluid from said second orifices by gravity flow.

5. The cmbination of claim 1, further comprising distancing means provided on said electrode means and abutting against carrier sheets in said path to thereby determine the width of said gap.

6. The constitution of claim 5, wherein said distancing means comprises a pair of shoes flanking said path, said orifices being disposed between said shoes.

7. The combination of claim 5, further comprising means for adjustably securing said distancing means to said electrode means so as to permit for changes in the width of said gap.

8. The combination of claim 1, wherein the maximum width of said gap is 0.5 mm.

9. The combination of claim 1, wherein the width of said gap decreases gradually, as considered in said direction.

10. The combination of claim 1, further comprising means for biasing said electrode means toward the carrier sheets in said path so as to reduce the width of said gap to zero in the absence of developing fluid between said electrode means and a carrier sheet in said path.

11. The combination of claim 1, wherein said conveyor means includes a cylindrical sheet-supporting peripheral surface and said electrode means has a complementary convex surface adjacent to said gap.

* * * * *